10/6/87 OR 4,698,639

United States Patent [19]

Mead et al.

[11] Patent Number: 4,698,639

[45] Date of Patent: Oct. 6, 1987

[54] CIRCULARLY POLARIZED LEAKY WAVEGUIDE DOPPLER ANTENNA

[75] Inventors: James B. Mead, Brookside, N.J.; Robert Bevan, Pleasantville, N.Y.; Leonard Schwartz, Montville, N.J.

[73] Assignee: The Singer Company, Stamford, Conn.

[21] Appl. No.: 818,646

[22] Filed: Jan. 14, 1986

[51] Int. Cl.[4] ..... H01Q 15/24

[52] U.S. Cl. ..... 343/756; 343/771; 343/779; 343/909

[58] Field of Search ..... 343/756, 872, 909, 779, 343/770, 771, 784; 333/21 A

[56] References Cited

U.S. PATENT DOCUMENTS 4,479,128 10/1984 Brunner et al. ..... 343/756
4,599,623 7/1986 Havkin et al. ..... 343/756

FOREIGN PATENT DOCUMENTS 115983 8/1984 European Pat. Off. ..... 343/756
1547291 6/1979 United Kingdom ..... 343/756

*Primary Examiner*—William L. Sikes
*Assistant Examiner*—Michael C. Wimer
*Attorney, Agent, or Firm*—David L. Davis

[57] ABSTRACT

An apparatus and a method for achieving simultaneous circular polarization of a four-beam doppler antenna wherein four different grid layers are positioned into a radome. The first grid layer, besides radiating a linear polarized beam, is used to partially reduce contaminants of the linearly polarized beam by means of cross-hatch strips. The second grid layer is used to further purify the linear polarized beam such that an essentially purified linear polarized beam is obtained. The third grid layer, designed according to certain equations, is used to convert the purified linearly polarized beam into a partially circularly polarized beam. And the fourth grid layer is used to make sure that the circularly polarized beam is perfectly matched.

18 Claims, 24 Drawing Figures

AXIAL RATIO $= \frac{OA}{OB}$ $20 \log \frac{OA}{OB}$ = AXIAL RATIO IN db OR ELLIPTICITY IN db

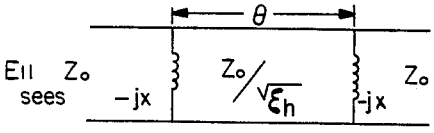
FIG. 8A
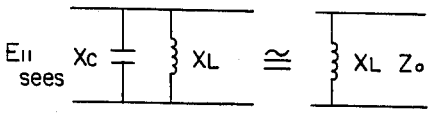
FIG. 8B
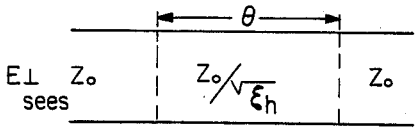
FIG. 8C
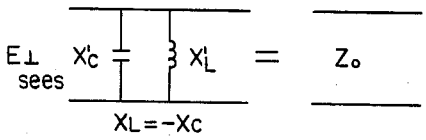
FIG. 8D
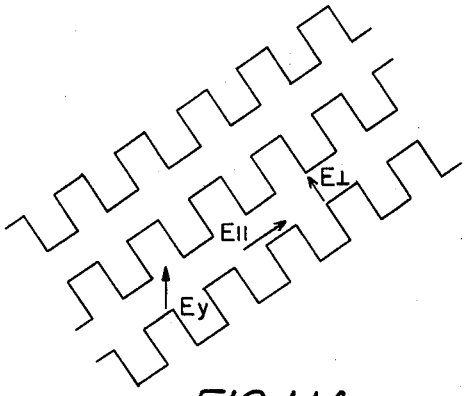
FIG. 11A
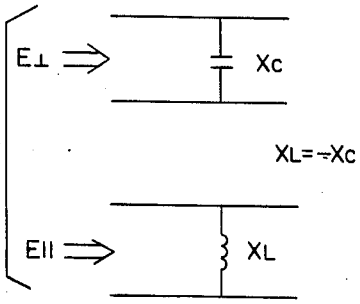
FIG. 11B
FIG. 11C
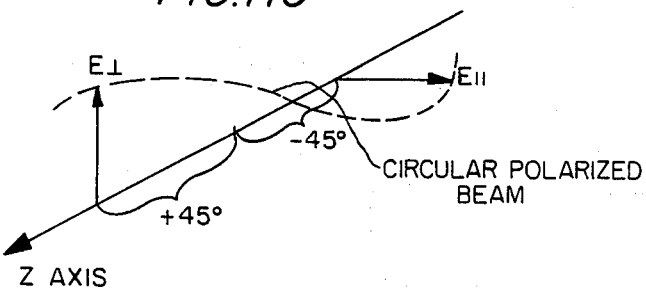

CIRCULARLY POLARIZED LEAKY WAVEGUIDE DOPPLER ANTENNA

FIELD OF THE INVENTION

The present invention relates in general to leaky waveguide doppler antennas and more particularly to a circularly polarized leaky waveguide doppler antenna.

BACKGROUND OF THE INVENTION

A typical doppler radar system used in navigation usually operates in a frequency region of approximately 10–20 GHz. The speed with which the aircraft is traversing can be ascertained by the integration of the phase shifting of the beam emitted from the doppler radar system. However, by operating in the 10–20 GHz region, the doppler system is not able to obtain as accurate a reading as desired for certain applications. Consequently, attempts have been made to shift the frequency region in which the doppler system operates to a higher frequency region such that the information obtained from the phase-shifted linear polarized beam would contain more information, thus contributing to a more accurate reading. However, as the frequency of operation increases, reflection of the transmitted signal by raindrops increases. This reflection causes errors in the computed velocity.

BRIEF DESCRIPTION OF THE PRESENT INVENTION

The present invention successfully resolves the aforesaid problems by utilizing a simultaneous circular polarization of a four-beam doppler antenna whereby four circularly polarized beams are sequentially emitted from the antenna aperture and point in four symmetrical directions offset from the perpendicular to the antenna.

It is, therefore, an object of the present invention to provide a circularly polarized leaky waveguide doppler antenna for reducing errors caused by reflections from raindrops.

The above-mentioned objectives and advantages of the present invention will become more apparent and the invention itself will be best understood by reference to the following description of an embodiment of the invention taken in conjunction with the accompanying drawings, wherein:

BRIEF DESCRIPTION OF THE FIGURES

FIGS. 8A and 8B illustrate the impedance seen by $E_{\parallel}$ in a transmission line format;

FIGS. 8C and 8D illustrate the impedance seen by $E_{\perp}$ in terms of a transmission line format;

FIGS. 11A–11C show the use of a meanderline configuration for replacing third and fourth layers, shown in FIGS. 9 and 10, respectively;

DETAILED DESCRIPTION OF THE INVENTION

Figure 1:
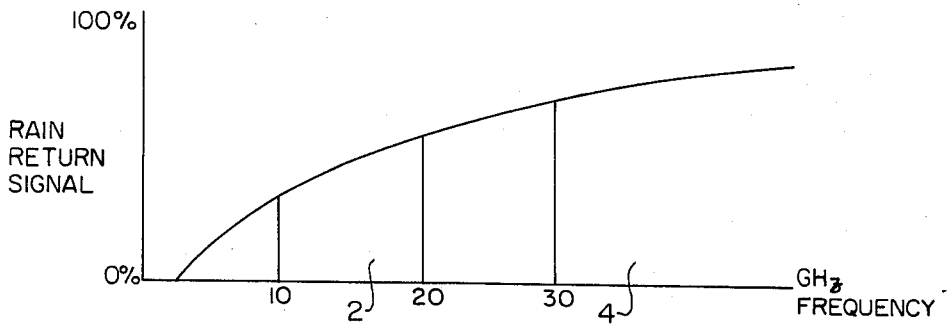
FIG. 1 is a graph plotting rain-return signal versus frequency.

A present-day four-beam leaky waveguide doppler antenna system operates in the approximately 10–20 GHz frequency range, shown as 2 in FIG. 1. One way to achieve improved navigational accuracy is to operate at a significantly higher frequency, for example at the frequency region represented by 4 in FIG. 1. However, at this high frequency, reflections from raindrops can cause serious navigational errors for a linear polarized doppler system. It has been known in the prior art that, if the power reflected by the raindrops is reduced, navigational errors are also reduced. To achieve this, the present invention proposes to use a circularly polarized leaky waveguide doppler antenna system for achieving the required rain rejection.

To convert a linear polarized beam into a circular polarized beam is known in the prior art. For example, see "A Planar Antenna Circular Polarization Converter Utilizing Printed Circuit Technology," Warren, K. A. J., *Marconi Review,* Vol. 43, No. 218, pages 176–184, 1980; "Meanderline Polarizer," Young, L., Robinson, L. A., Hacking, C. A., *IEEE Transaction on Antennas and Propagation,* May, 1973, pages 376–378; and *Waveguide Handbook,* Marcuvitz, N., pages 280–285, McGraw-Hill, New York, 1951. However, the methods taught by these references deal only with the conversion of one linear polarized beam into a corresponding circular polarized beam emitted at one particular beam angle, whereas the present invention proposes to simultaneously convert all four beams of a linear polarized leaky waveguide doppler system into four corresponding circularly polarized beams.

Figure 2A:
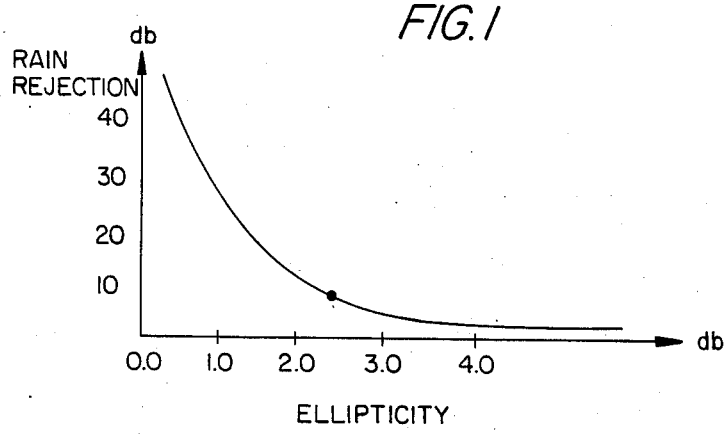
FIG. 2A is a rain-rejection versus ellipticity diagram.
Figure 2B:
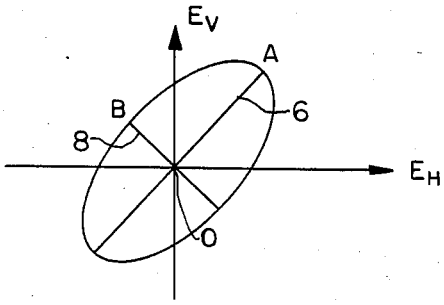
FIG. 2B shows an ellipticity graph.

Referring to FIG. 2A, there is shown a graph plotting rain-rejection versus ellipticity of the raindrop. Suppose that a microwave signal, i.e. a beam, is sent during rain. Because a raindrop has a finite size, it acts as a reflector. Hence, the higher the frequency, the larger the reflection of the raindrop appears to the radar system, in terms of the wavelength of the latter. And when the size of a raindrop becomes an appreciable fraction of the wavelength of the beam, the reflection of the raindrop will cause the radar system to perceive erroneously in terms of the phase-shifted images obtained from the transmitted beam. Assuming that the raindrops are spherical, if a circularly polarized beam is emitted from the antenna and hits the raindrops, the reflections of the spherical raindrops are of an opposite polarization sense and thus are discriminated against. Although raindrops are not perfectly spherical, and thus are not perfect reflectors of the incoming wave, the imperfections are not a limiting factor in this design. The polarization of a wave is measured by its axial ratio as shown in FIG. 2B. The polarizer described herein will yield a wave with axial ratio equal to 2.5 db. This leads to a rain rejection of approximately 10 db, as shown in FIG. 2A. It should be appreciated that the specific ellipticity value of 2.5 db is by no means to be limiting, as a higher or lower ellipticity value can also be mandated. In which case, it should be noted that the rain rejection would also be increased or decreased.

Figure 3:
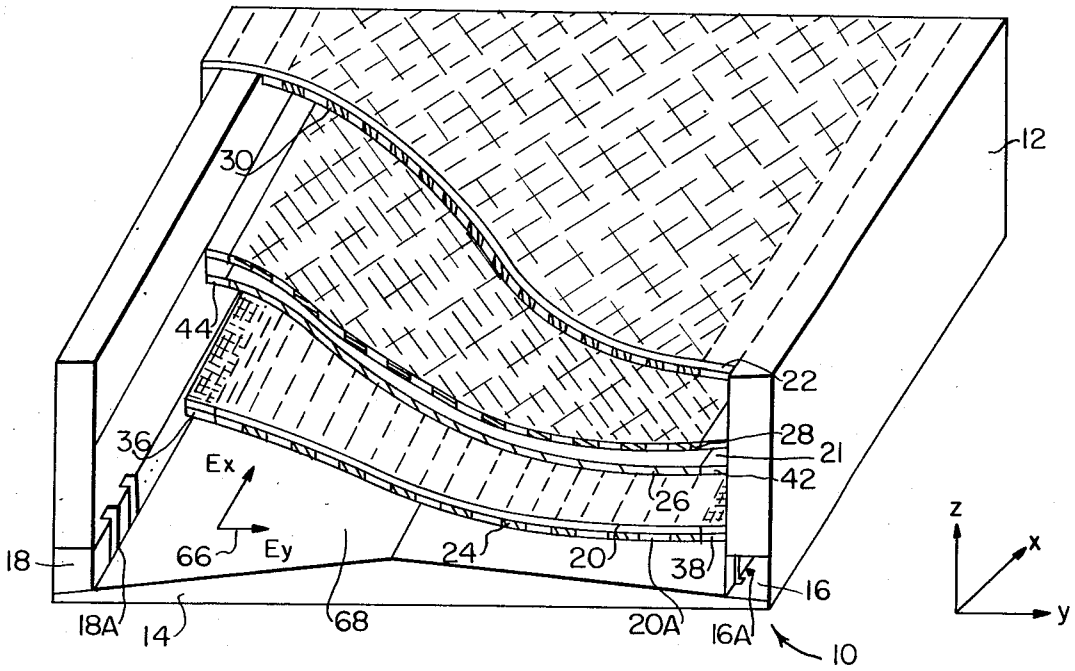
FIG. 3 is an exposed perspective view of an antenna of the present invention.

FIG. 3 illustrates an embodiment of the antenna which constitutes the present invention. As shown, antenna 10 is enclosed in a radome 12. It should be noted that a reflector 14 is located at the bottom of the antenna assembly. The purpose of the reflector is, as the name implies, to reflect radiation, as sequentially emitted linear beams, fed in from feed i.e. waveguides 16 and 18. As is well known, see for instance U.S. Pat. No. 3,721,988 issued to Schwartz, et al., and assigned to the same assignee as the present invention, the radiation reflected by the reflector as sequential linear beams comes from the feed guides when power is alternately fed to different feed points thereof. Also enclosed in radome 12 are three layers of substrates 20, 21 and 22. These substrates are conventionally used in the art and are known as G-10 substrates. For the sake of clarity, it should be noted that antenna 10 is not drawn to scale.

Figure 4:
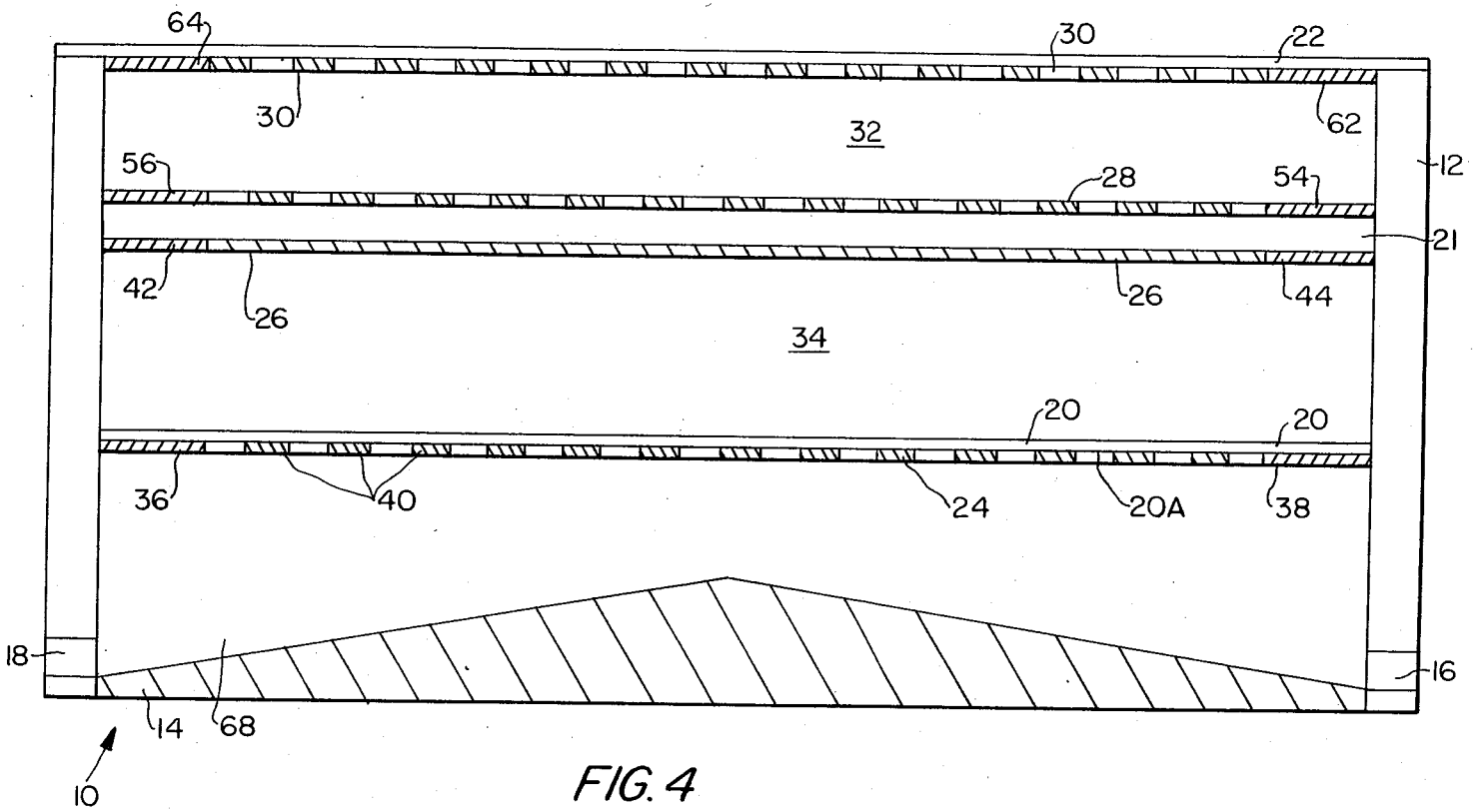
FIG. 4 shows a cross-sectional view of the antenna shown in FIG. 3.
Figure 5:
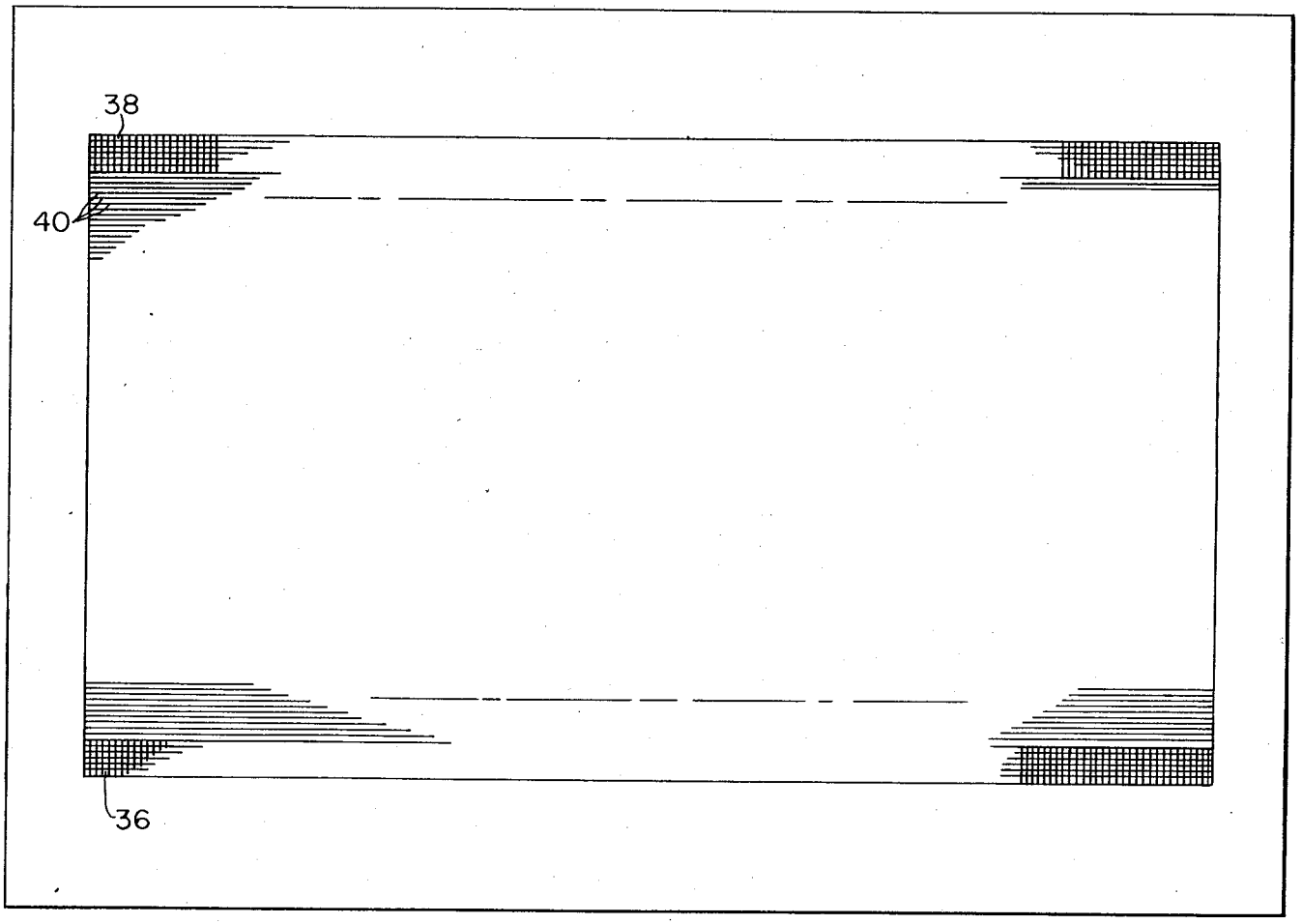
FIG. 5 is a complete plan view of a first grid layer of the antenna shown in FIG. 3.

On the lower surface 20*a* of substrate 20 is etched a radiating grid layer 24, which is shown as a complete plan view in FIG. 5. This printed grid has been throughly described in the aforenoted U.S. Pat. No. 3,726,988. In essence, what radiating grid layer 24 does is to shape the linear polarized beams emitted from the reflector. On the lower surface of substrate 21 is etched a second grid layer 26. Opposed thereto and etched on the upper surface of substrate 21 is a third grid layer 28. Superposed on grid layer 28 and etched onto substrate 22 at its bottom surface is a fourth grid layer 30. A similarly numbered cross-sectional representation of the different layers illustrated in FIG. 3 is shown in FIG. 4. As can more readily be seen in FIG. 4, interposed between grids 30 and 28 and grids 26 and substrate 20 are spacers 32 and 34, respectively. The spacers are made from phenolic honeycomb, which is conventionally known.

As was stated previously, the complete plan view of radiating grid layer 24 is shown in FIG. 5, wherein it is also shown that two cross-hatch parallel strips 36 and 38 are meshed onto radiating grid layer 24. Upon closer inspection of radiating grid layer 24, it can be seen that the grid is made up of a plurality of equally spaced parallel conductive lines 40. Although drawn as rectangular blocks in FIG. 4 for easier illustration purposes, it should be noted that conductive lines 40 are, in fact, lines on the radiating grid. As shown, the conductive lines on radiating grid 40 run parallel along the longitudinal axis.

Figure 6:
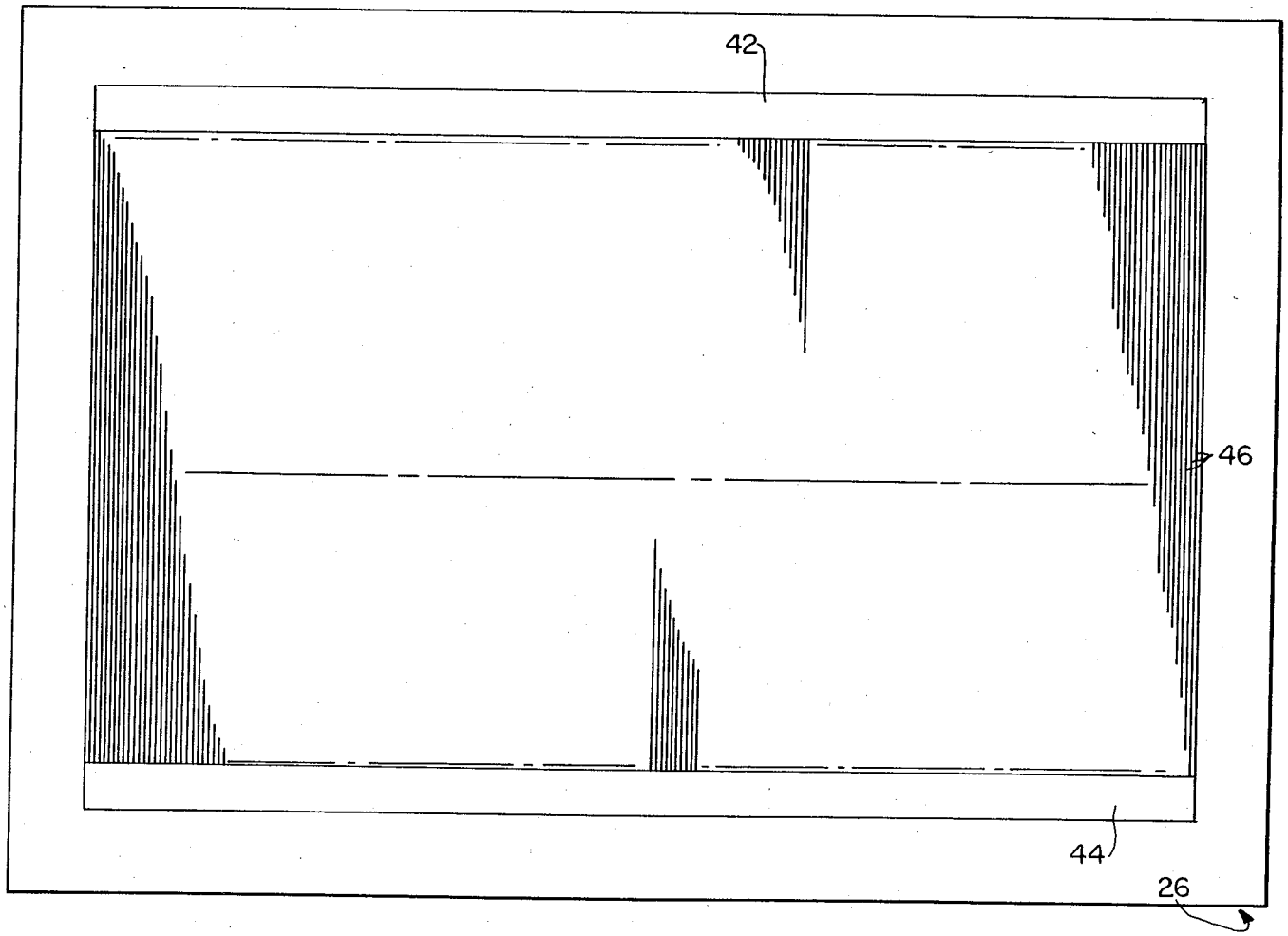
FIG. 6 is a complete plan view of a second grid layer of the antenna shown in FIG. 3.

Grid 26 is shown in its entirety in FIG. 6. As shown therein, the equally spaced conductive lines of grid 26 run parallel in the cross direction. And as can be seen in FIGS. 3 and 4, the orientation of the conductive lines of grid 26 is perpendicular to that of conductive lines 40 of grid 24. Along the longitudinal axis of grid 26 and contiguous to both ends of conductive lines 46 are two copper strips 42 and 44. As was stated previously, radiating grid 26 is etched onto the lower surface of substrate 21.

Figure 9:
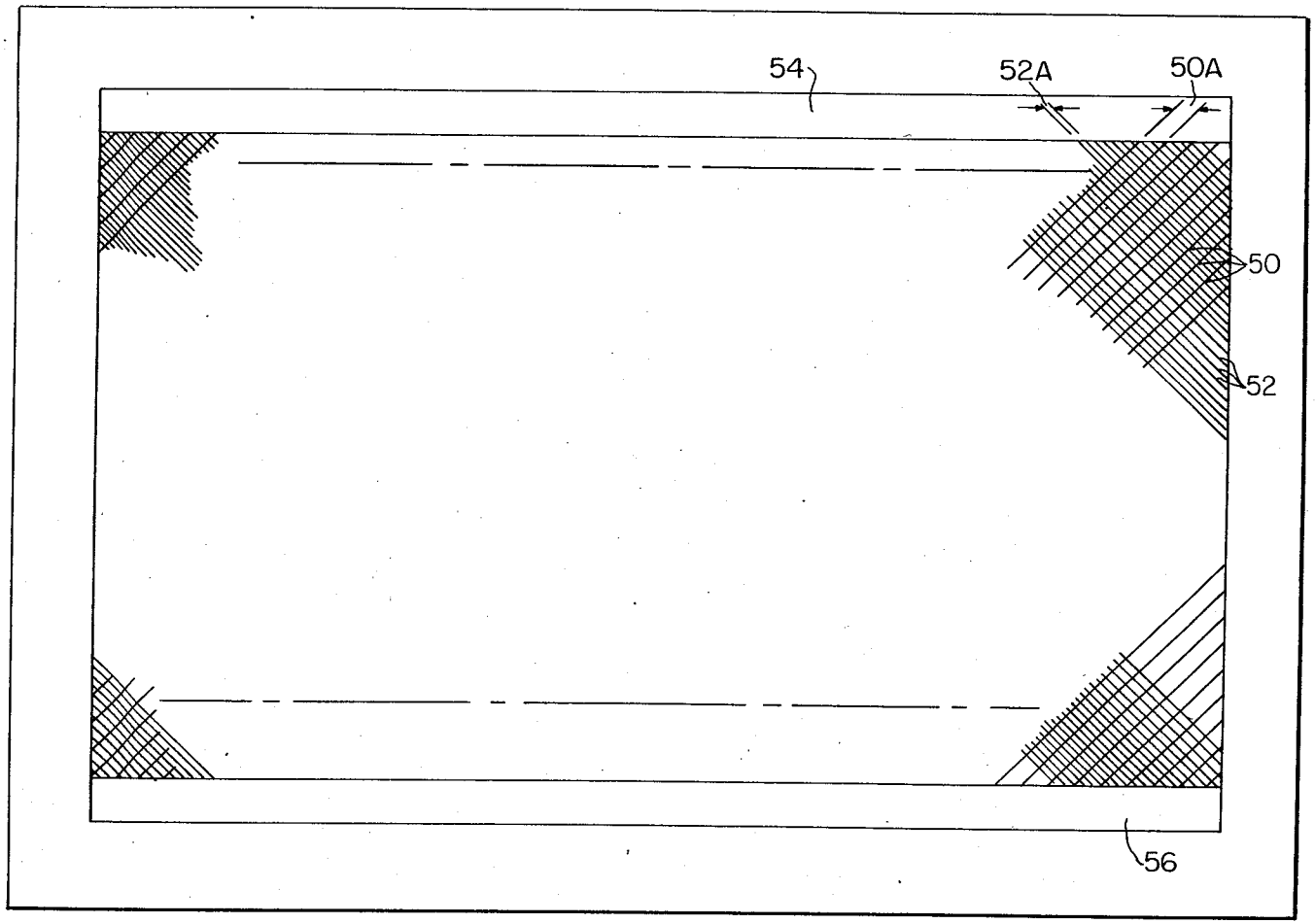
FIG. 9 is a complete plan view of the third layer of the antenna shown in FIG. 3.

On the top surface of substrate 21 is etched grid 28, which is shown in complete detail in FIG. 9. As can be seen in FIGS. 3 and 9, grid 28 includes two sets of equally spaced parallel conductive lines running perpendicularly to each other. The set of parallel lines which runs in the direction indicated by direction indicator 48 is designated as 50, whereas the set of parallel lines which runs in the direction indicated by directional indicator 51 is designated as 52. As noted, the spacing between adjacent parallel lines of set 52, for example, as indicated by 52*a*, is smaller than the spacing between adjacent parallel conductive lines, for example 50*a*, of set 50. The significance of the difference between the spacings of the two sets of conductive lines will be explained later in the specification. Also etched on grid layer 28 are two strips of copper 54 and 56, along the longitudinal edges of the two sets of conductive lines.

Figure 10:
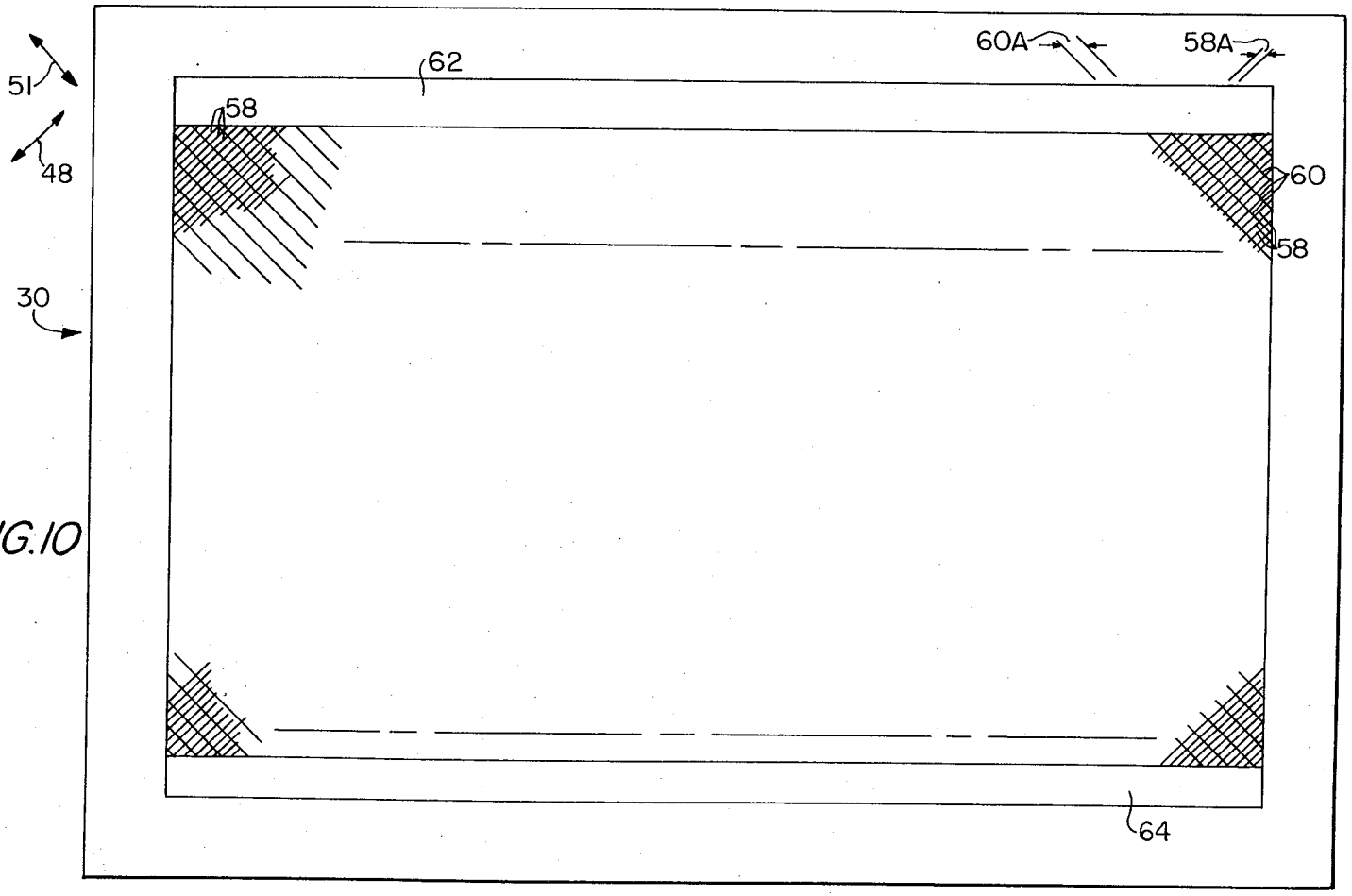
FIG. 10 is a complete plan view of the fourth layer of the antenna shown in FIG. 3.

Referring now to FIG. 4 there is shown a spacer layer of honeycomb material 32 separating grid layer 28 from the next conductive grid layer 30, which is shown in complete detail in FIG. 10 and shown as etched on the underside of substrate 22 in FIG. 3. Referring now to FIG. 10, it should be appreciated that grid layer 30, similar to grid layer 28, includes two sets of equally spaced parallel lines 58, which run along the direction as indicated by directional indicator 48, and 60, which runs along the direction as indicated by directional indicator 51. Along the longitudinal edges of the two sets of conductive lines are etched copper strips 62 and 64. Like the layout of grid layer 28, the spacing between adjacent parallel lines of the two sets of conductive lines in grid 30 are also different. However, it should be appreciated that, in this instance, the spacing between parallel lines of set 60, designated as 60*a*, is greater than the spacing 58*a* of set 58. This is the reverse of the spacing difference in grid layer 28. The significance of the difference in spacing between parallel sets of conductive lines—along with the rationale under which antenna 10 is structured as it was described hereinabove and the requirements for incorporating the different grid layers—is to be discussed hereinbelow.

For the present invention of converting a linearly polarized four-beam leaky waveguide doppler antenna to a circularly polarized four-beam doppler antenna, three requirements are needed. Firstly, there is a need for blocking the radiation near the feed lines and the side edges of the antenna for reducing cross polarization. Secondly, a nearly pure linearly polarized beam must be obtained by use of a polarization rejection grid. Thirdly, circularly polarized printed structures having phase shifts for creating a circularly polarized main beam must be incorporated into the antenna.

Discussing the first and second requirements, attention is directed to FIG. 3, wherein an electromagnetic field 66 is shown. As drawn, electromagnetic field 66 is separated into two components, $E_x$ and $E_y$. For this discussion, it should be noted that field $E_x$ is the desirable field; and field $E_y$ is considered a contaminant field and should be eliminated as much as possible. If $E_y$ is not eliminated, it would tend to contaminate any polarized beam coming out the antenna. The magnitude of $E_y$ is greatest near the longitudinal edge of waveguides 16 and 18, being a result of radiation from slots 16*a* and 18*a*. Due to the orientation of $E_y$ with respect to grid lines 40 of grid layer 24, it may leak freely from the cavity, as explained hereinbelow. To partially eliminate $E_y$ leakage, two parallel strips of cross-hatch grids 36 and 38 are etched along the longitudinal edges of grid layer 24.

Figure 7A:
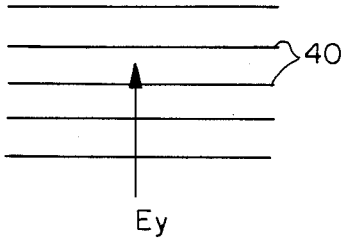
FIGS. 7A–7D show diagrams representing the breaking up of $E_y$ into parallel and perpendicular components.
Figure 7B:
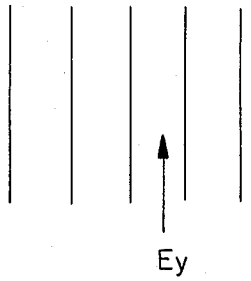

Regressing now for a moment to why cross-hatch grids 36 and 38 are able to partially eliminate $E_y$, attention is directed to FIGS. 7A and 7B. In FIG. 7A it is shown that $E_y$ is traveling in a direction perpendicular to a number of conductive lines, for instance lines 40 of grid layer 24. When $E_y$ is perpendicular to conductive lines 40, it would pass essentially unattenuated. However, as is well known, when $E_y$ travels along the length of parallel conductive lines, for example as shown in FIG. 7B, it would be rejected. Thus, as $E_y$ is traveling parallel with a set of conductive lines in the cross-hatch grids 36 and 38, it, likewise, is rejected. Yet, the $E_y$ rejection by the first grid layer 24 is not complete, leading to a need for a second grid layer. Hence, a second grid layer 26, which has equally spaced lines running parallel with $E_y$, is superposed over grid layer 24. As was noted previously, two parallel strips of copper 42 and 44 are etched at the longitudinal edges of grid layer 26. The combination of these strips of copper and conductive lines 46 reduces $E_y$ to such a level that an essentially pure linear polarized beam is obtained after grid layer 26. For grid layer 24, it should be noted that the cross-hatch grids 36 and 38 are approximately 0.013 inch wide and are spaced at 0.085 wavelength for this embodiment. It should also be noted that these dimensions are not to be limited only by these numbers.

Figure 7C:
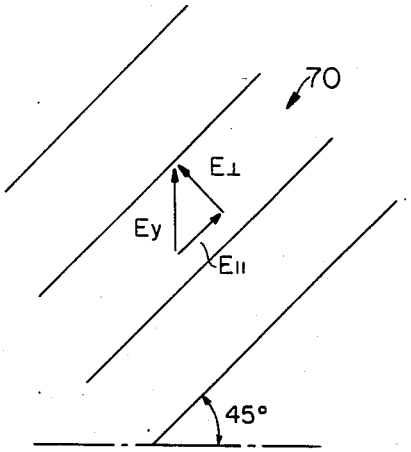
Figure 7D:
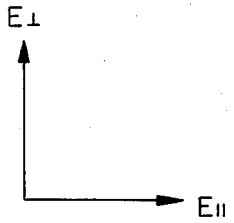
Figure 7E:
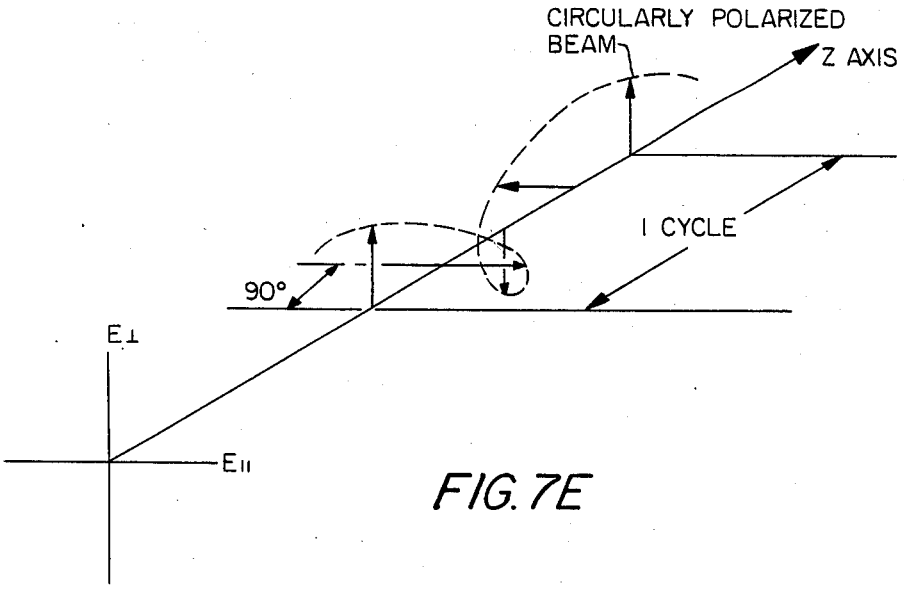
FIG. 7E shows the spatial shifting of the parallel component of $E_y$ by 90° to get circular polarization.

Before venturing into a discussion of how the present invention converts a linear polarized beam into a circularly polarized beam, consider the following. As shown in FIG. 7C, an electromagnetic field $E_x$ may be broken into two components, $E_{\parallel}$ and $E_{\perp}$. As indicated, the $E_{\parallel}$ field travels in parallel to the conductive lines of a grid 70, whereas the $E_{\perp}$ field runs perpendicularly to the same conductive lines. While $E_{\perp}$ passes through grid 70 essentially unperturbed, it does see a small capacitive reactance. On the other hand, $E_{\parallel}$ sees the grid as strongly inductive and is phase advanced accordingly. Thus, to achieve perfect circular polarization, $E_{\parallel}$ must be advanced 90° from $E_{\perp}$, as shown in FIG. 7E. Also, both waves must pass unattenuated through the grid. Therefore, a second grid is required in order to match out the inductance seen by $E_{\parallel}$ from the first grid.

For the present invention, in order to achieve circular polarization, a grid layer 28, which corresponds to the first grid 70 discussed hereinabove, is etched on top of substrate 21. The second grid, as discussed above, is represented by grid 30, which is etched on the underside of substrate 22. For this example, the two grids 28 and 30 are separated by honeycomb spacer 32, as shown in FIG. 4. The sandwich structure represented by grid layer 28, honeycomb 32 and grid layer 30, may be modeled as a transmission line circuit, shown in FIGS. 8A–8B. FIG. 8A represents a transmission line model wherein $-JX$ equals the inductive reactance of the grid as seen by $E_{\parallel}$, $\theta$ equals the electrical spacing of the grids, Eh equals the dielectric constant of the honeycomb spacer and $Z_0$ equals the characteristic impedance of free space.

As was stated previously, a third requirement for converting a linearly polarized four-beam antenna into a circularly polarized four-beam antenna is needed. For this requirement, the orientation between grid layers 28 and 30 in the sandwich structure, as well as the spacing between the different sets of parallel conductive lines, have to be determined according to three conditions. First, the phase shift between $E_{\parallel}$ and $E_{\perp}$ must be 90°. Second, the input reflection coefficient, S11, of the grids as seen by $E_{\parallel}$ must be zero. Third, the input reflection coefficient, S11, as seen by $E_{\perp}$ must be near zero. From the literature it is known that condition one is satisfied when $$Z_0/x=\{(Eh+1)+2\,(Eh^2+1)^{\frac{1}{2}}\} \qquad \text{(Eq. 1)}$$

where:

$Z_0$=the impedance of free space, x=the inductive reactance of the wire grid as seen by $E_{\parallel}$, and Eh=the dielectric constant of the honeycomb spacer.

For this example, the spacer material selected has a dielectric constant of approximately 1.04. Using this value in Equation 1 yields a value of $Z_0/x$ of 2.020. And once $Z_0/x$ is known, the grid spacing and line thickness may be found in accordance to the Marcuvitz reference, cited earlier. A resulting spacing of 0.246 wavelength and line width of 0.013 were calculated.

The second condition, wherein the input reflection coefficient as seen by $E_{\parallel}$ must be zero is met when the following equation is used:

$$\tan\theta = \frac{-2z_0}{x}\cdot\frac{\sqrt{Eh}}{\left(\frac{z_0}{x}\right)^2-(Eh-1)} \qquad \text{(Eq. 2)}$$

Given the value for $Z_0/x$, which is calculated from Equation 1, the phase shift $\theta$ is calculated to be 2.346 radians from which the space of thickness is found from the desired operating frequency. The third condition enunciated above may not be met exactly, but for the values of Eh near one, the input reflection coefficient, S11, as seen by $E_{\perp}$ is found to be small. For example, for Eh of 1.04, S11 perpendicular equals to 0.0039. This represents a power reflection of only 0.0015 percent.

In addition to the above-mentioned three conditions, the actual design of the antenna assembly of the present invention requires an additional grid of wires perpendicular to the grid construction described hereinabove, in order to match out the small capacitive reactance seen by $E_{\perp}$. This capacitive reactance comes about from the honeycomb thickness, as well as the previously described grid. Thus, referring to grid layer 28 in FIG. 9, it can be seen that two sets of equally spaced conductive lines are etched onto the same grid layer. For this embodiment, **52*a* represents the conductive line spacing $E_{\parallel}$ while 50*a* represents the conductive line spacing for $E_{\perp}$. Thus, referring back to FIGS. 8A–8D, it is illustrated that $E_{\parallel}$ sees conductive lines 52 as an inductor $X_L$ while $E_{\perp}$ sees the same conductive lines as capacitors $X'_C$. Also, $E_{\parallel}$ sees conductive lines 50 as a capacitor $X_C$, while $E_{\perp}$ sees conductive lines 50 as an inductor, $X'_L$. Referring to FIG. 8B, $X_C$ is much less than $X_L$, therefore, $X_C$ is usually neglected. Referring to FIG. 8D**, since $X'_L=X'_C$, they will cancel; and $E_{\perp}$ passes unperturbed.

To summarize, for the three conditions needed to achieve circular polarization, condition one is met when $E_{\parallel}$ is phase shifted 90° as shown in FIG. 7E. This is obtained from the mathematical analysis of Equation 1. Condition two is met when Equation 2 is analyzed. From Equation 2 the spacing, i.e. $\theta$, between the conductive lines is obtained. Although condition three may not be met perfectly, because it turns out that power reflection is very tiny, $E_\perp$ can be kept from reflecting back to the cavity of the radome assembly, per discussion pertaining to FIG. 8D, infra. By having met all three conditions, it is readily apparent that the narrower set of conductive lines, for this embodiment 52, performs the bulk of work. In other words, this set of conductive lines is phase shifting $E_\perp$ 90°, thereby providing circular polarization.

Grid layer 30 is required for this embodiment because of the simple fact that, if only one grid layer is used, there will be an impedance mismatch. And there is no way of tuning out this mismatch without adding an additional grid layer, such as 30.

Having described the theory and the requirements needed for converting a four-beam linear antenna into a four-beam circularly polarized antenna, it should now be apparent that the embodiment of the present invention, as shown in FIGS. 3 and 4, represents a four-beam leaky waveguide antenna which is capable of achieving simultaneous circular polarization of the four beams.

Figure 13:
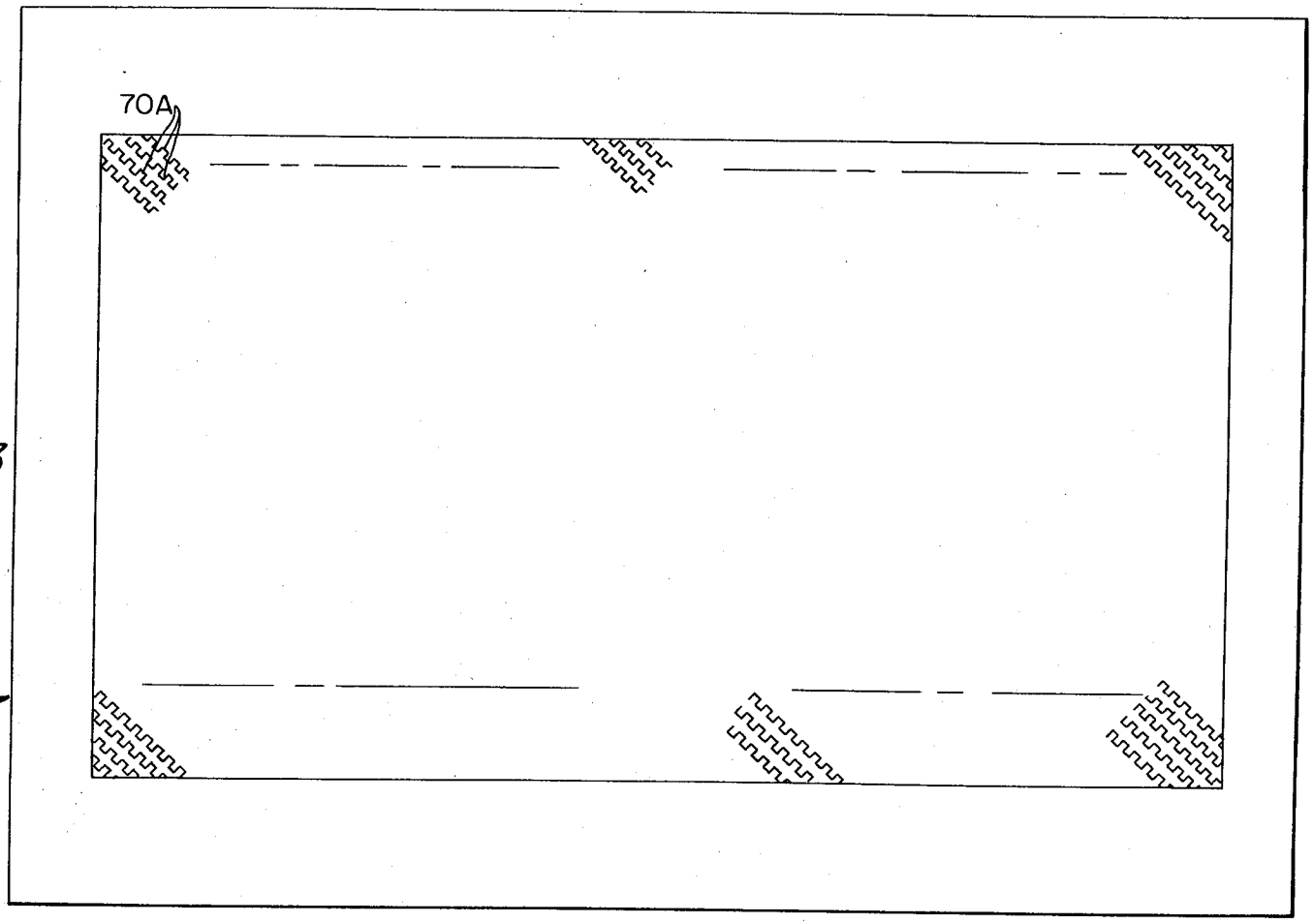
FIG. 13 is a complete plan view of a layer of meanderlines used in FIG. 12.
Figure 14:
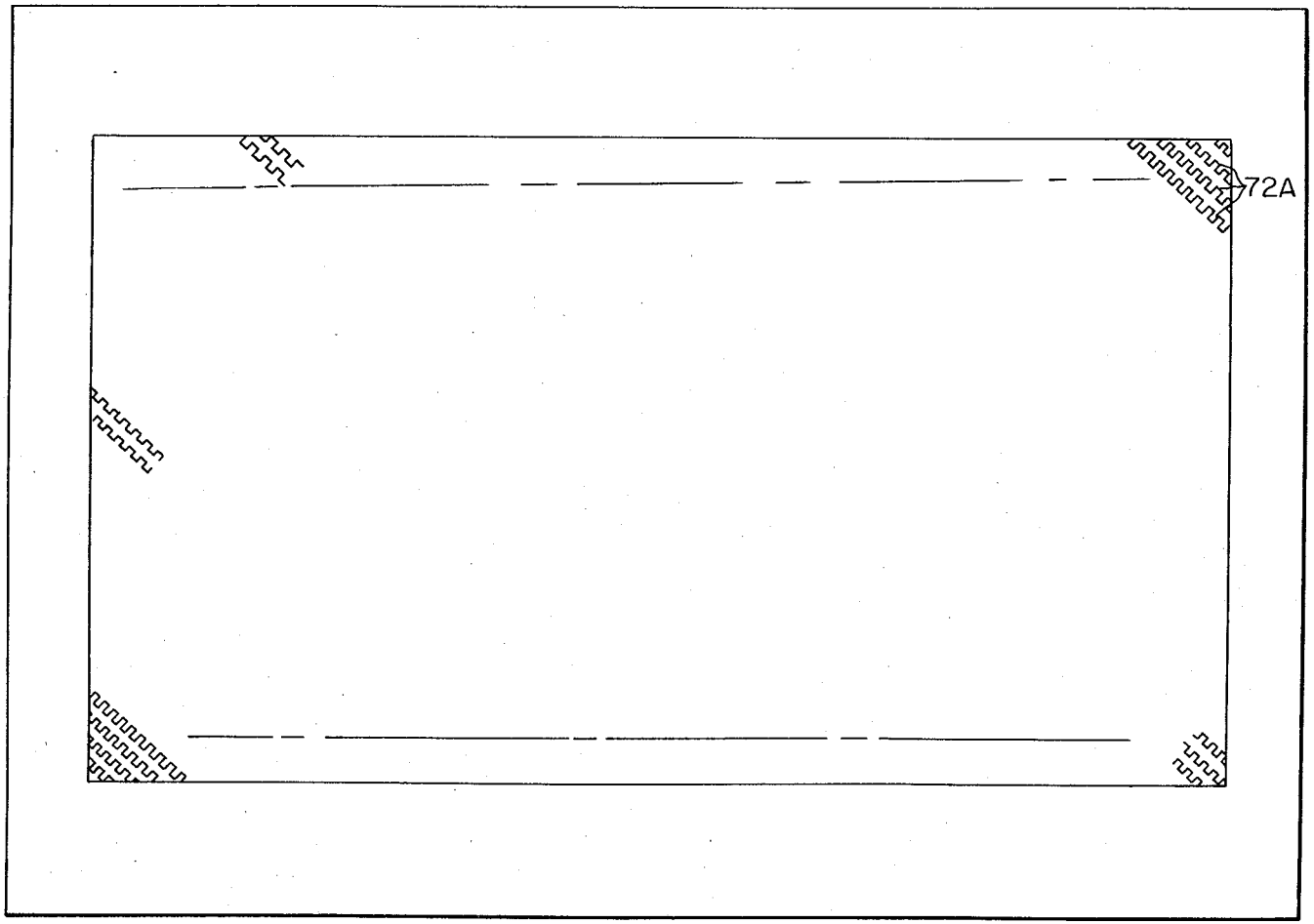
FIG. 14 is a complete plan view of a meanderline layer used for the fourth layer of the embodiment shown in FIG. 12.

A second embodiment of the present invention uses, instead of grid layers 28 and 30, as shown in FIGS. 9 and 10, respectively, two grid layers comprising equally spaced meandering lines, shown as plan views in FIGS. 13 and 14. As shown in FIG. 11A, the electromagnetic field $E_y$ is again separated into a perpendicular component $E_\perp$ and a parallel component, $E_{||}$. Using the same analysis previously discussed, it is shown, per FIG. 11B, that $E_\perp$ sees a capacitance between two adjacent meandering lines while $E_{||}$ sees an inductance between the same. Hence, instead of shifting $E_{||}$ 90° as in the previous embodiment, the second embodiment mandates the shifting of $E_{||}$ −45°, i.e. 45° backward, and the shifting of $E_\perp$ forward 45°, as shown in FIG. 11C. Thus, a perfectly circular polarization can still be obtained, as the summation of a forward 45° and a backward 45° would still yield a 90° phase shift. Again, this half wave phase shift for $E_\perp$ and $E_{||}$ is due to the fact that $E_\perp$ sees the meandering lines as a large capacitance while $E_{||}$ sees the same as a large inductance.

Figure 12:
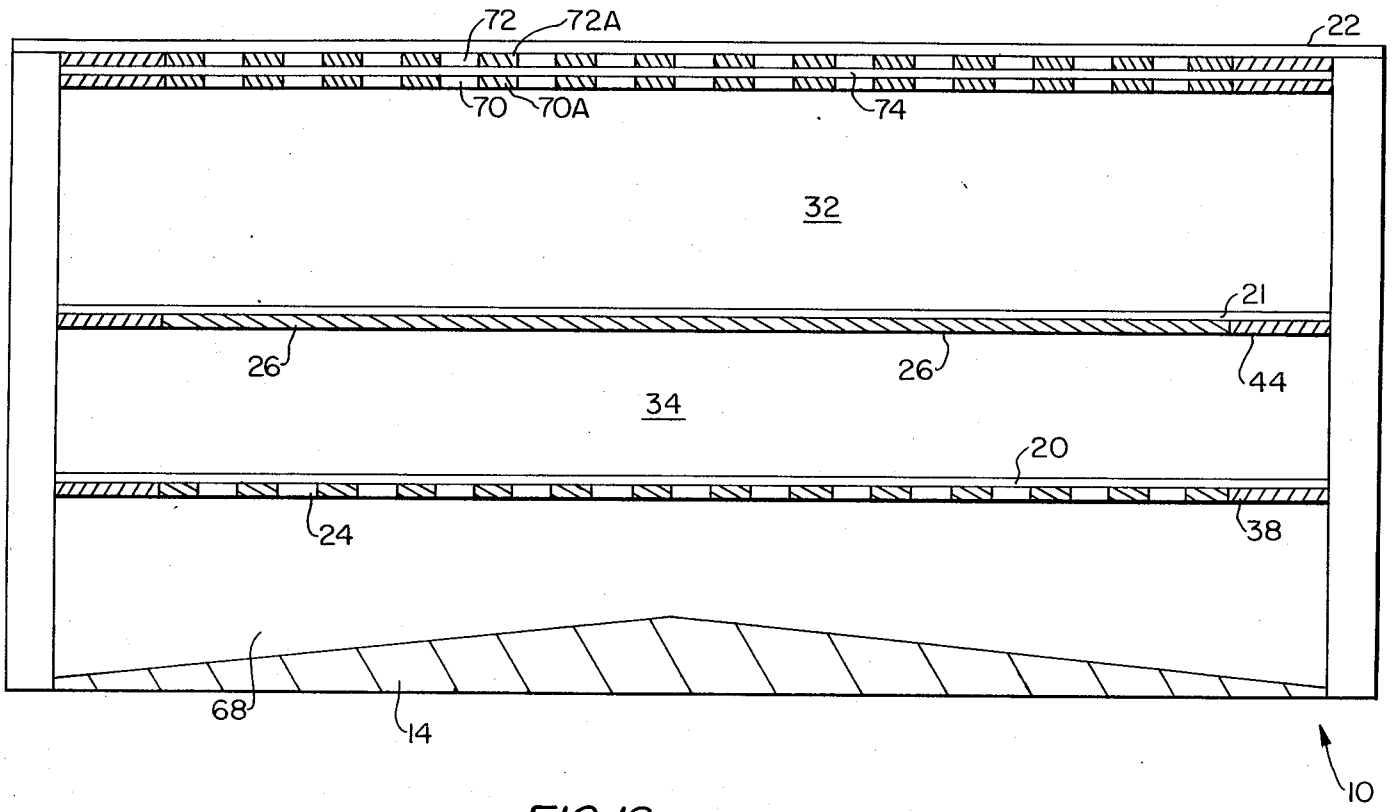
FIG. 12 is a cross-sectional view of an embodiment of the present invention which uses meanderlines.

Referring to FIG. 12, it can be seen that four grid layers are also embodied in this structure. As the lower two layers are the same as the first embodiment, no further discussion thereto is needed. As for the upper two layers, it can be seen that a meanderline grid layer 70 is etched onto the underside of substrate 74; and a similar meanderline grid layer is etched onto the top surface of the same. As the meanderlines are inherently different from straight conductive lines, slight modifications to the spacing, for example honeycomb spacer 32, and the addition of a substrate between the two meanderline grid layers are incorporated into the second embodiment of this invention. Otherwise, the design for this second embodiment is conceptually the same as that of the first. From experimentation, an antenna employing the meanderline polarizer showed rain rejection, like that of the inductive polarizer, i.e. the crisscross conductive lines, to be better than 10 db on all four beams.

While preferred embodiments of the invention are disclosed herein for purposes of explanation, numerous changes, modifications, variations, substitutions and equivalents, in whole or in part, will now be apparent to those skilled in the art to which the invention pertains. Accordingly, it is intended that the invention be limited only by spirit and scope of the appended claims.

We claim:

1. A leaky waveguide antenna for generating at least one circularly polarized beam to eliminate errors caused by raindrop reflections, the leaky waveguide antenna comprising:

waveguides working cooperatively with reflector means for emitting a linear beam;

a first layer of equally spaced co-planar parallel conductive lines positioned in front of the reflector means for polarizing the linear beam;

a second layer of equally spaced co-planar parallel conductive lines positioned in parallel spaced relation to the first layer, the parallel conductive lines of the second layer being oriented perpendicularly to the conductive lines of the first layer for substantially purifying the linearly polarized beam;

a third layer, having a dual set of spaced co-planar parallel conductive lines aligned perpendicularly to each other, superposed over the second layer, the dual set of co-planar conductive lines positioned diagonally to the second layer of conductive lines for polarizing the substantially purified linearly polarized beam into a partially circularly polarized beam; and a fourth layer, having a second dual set of spaced co-planar parallel conductive lines aligned perpendicularly to each other, superposed over the third layer, the second dual set further polarizing the partially circularly polarized beam into a circularly polarized beam for substantially eliminating the errors caused by the raindrop reflections.

2. The leaky waveguide antenna according to claim 1, further comprising:

two separate sets of equally spaced parallel conductive lines mating perpendicularly and co-planarly with the first layer of conductive lines along opposed longitudinal edges thereof for forming two parallel strips of cross-hatch conductive lines contiguos to opposed longitudinal edges of the first layer, wherein stray cross-polarized energy components of the linearly polarized beam are reduced by the cross-hatch strips.

3. The leaky waveguide antenna according to claim 1, further comprising:

copper strips connected co-planarly alongside of and contiguous to longitudinal edges of the second layer for reducing additional stray cross-polarized energy components of the linearly polarized beam.

4. The leaky waveguide antenna according to claim 1, further comprising:

copper strips connected co-planarly alongside of and contiguous to longitudinal edges of the third and fourth layers for reducing stray components of the circularly polarized beam.

5. The leaky waveguide antenna according to claim 1, wherein the conductive lines of the second and third layers are etched on opposed surfaces of a substrate.

6. The leaky waveguide antenna according to claim 1, wherein each respective set of the dual set of conductive lines of the third layer has equally spaced parallel lines therein; and wherein the space between the parallel line for corresponding each of the dual set is different.

7. The leaky waveguide antenna according to claim 6, wherein each respective set of the second dual set of conductive lines of the fourth layer has equally spaced parallel lines therein; and wherein the space between the parallel lines for corresponding each of the second dual set is different.

8. A four-beam leaky waveguide antenna for generating circularly polarized beams to eliminate errors caused by raindrop reflections, the four-beam leaky waveguide antenna comprising:

a reflector having waveguides proximately positioned at opposing edges thereof for radiating four linear beams when power is alternately fed to different feed points of the waveguides;

a first layer including a first set of equally spaced co-planar parallel conductive lines for polarizing the linear beams, the first layer further including two separate sets of equally spaced parallel conductive lines mating perpendicularly and co-planarly with the first set of conductive lines for forming two parallel strips of cross-hatch conductive lines, the two parallel cross-hatch conductive strips being located alongside of and contiguous to opposed longitudinal edges of the first layer for reducing stray cross-polarized energy components of the linearly polarized beams;

a second layer of equally spaced co-planar parallel conductive lines positioned in parallel spaced relation to the first layer, the conductive lines of the second layer being positioned perpendicularly to the conductive lines of the first layer, the second layer further including two continuous copper strips each connected co-planarly alongside of and contiguous to longitudinal edges of the second layer for substantially purifying the linearly polarized beams by reducing additional stray components therefrom;

a third layer having a dual set of space co-planar parallel conductive lines aligned perpendicularly to each other superposed over the second layer, the conductive lines of the dual set being positioned diagonally to the conductive lines of the second layer for polarizing the purified linearly polarized beams into partially circularly polarized beams, each respective set of the dual set having equally spaced parallel conductive lines therein, and the space between the parallel lines for corresponding each of the dual set being different; and a fourth layer having a second dual set of equally spaced co-planar parallel conductive lines aligned perpendicularly to each other superposed over the third layer, the second dual set further polarizing the partially circularly polarized beams into circularly polarized beams, each respective set of the second dual set having equally spaced parallel conductive lines therein, and the space between the parallel lines for corresponding each of the dual set being different;

whereby errors caused by raindrop reflections are substantially eliminated by the circularly polarized beams.

9. A four-beam leaky waveguide antenna for generating circularly polarized beams to eliminate errors caused by raindrop reflections, the four-beam leaky waveguide antenna comprising:

a reflector having waveguides proximately positioned at opposing edges thereof for radiating four linear beams when power is alternately fed to different feed points of the waveguides;

a first layer of equally spaced co-planar parallel conductive lines for linearly polarizing the linear beams;

a second layer of equally spaced co-planar parallel conductive lines positioned in parallel spaced relation to the first layer, the conductive lines of the second layer being oriented perpendicularly to the conductive lines of the first layer for purifying the linearly polarized beams;

a third layer of equally spaced co-planar parallel meandering conductive lines positioned in spaced relation to the second layer, the meandering lines of the third layer superposed diagonally over the conductive lines of the second layer for polarizing the purified linearly polarized beams into partially circularly polarized beams; and a fourth layer of equally spaced co-planar parallel meandering conductive lines superposed over the third layer of meandering conductive lines for further polarizing the partially circularly polarized beams into circularly polarized beams, thereby substantially eliminating the errors caused by raindrop reflections.

10. The four-beam leaky waveguide antenna according to claim 9, further comprising:

two separate sets of equally spaced parallel conductive lines mating perpendicularly and co-planarly with the first layer of the conductive lines along opposed longitudinal edges thereof for forming two parallel strips of cross-hatch conductive lines contiguous to opposed longitudinal edges of the first layer, wherein stray cross-polarized energy components of the linearly polarized beams are reduced by the cross-hatch strips.

11. The four-beam leaky waveguide antenna according to claim 9, further comprising:

copper strips connected co-planarly alongside of and contiguous to longitudinal edges of the second layer for reducing additional stray components of the linearly polarized beams.

12. The four-beam leaky waveguide antenna according to claim 9, further comprising:

copper strips connected co-planarly alongside of and contiguous to longitudinal edges of the third and fourth meandering conductive line layers for reducing stray components of the circularly polarized beams.

13. A four-beam leaky waveguide antenna for generating circularly polarized beams to eliminate errors caused by raindrop reflections, the four-beam leaky waveguide antenna comprising:

a reflector having waveguides proximately positioned at opposing edges thereof for radiating four linear beams when power is alternately fed to different feed points of the waveguides;

a first layer having a first set of equally spaced co-planar parallel conductive lines for polarizing the linear beams, the first layer further including two separate sets of equally spaced parallel conductive lines mating perpendicularly and co-planarly with the first set of conductive lines along opposed longitudinal edges thereof for forming two parallel strips of cross-hatch conductive lines contiguous to opposed longitudinal edges of the first layer, the cross-hatch conductive strips reducing stray components of the linearly polarized beams;

a second layer of equally spaced co-planar parallel conductive lines positioned in parallel spaced relation to the first layer, the conductive lines of the second layer being oriented perpendicularly to the conductive lines of the first layer for purifying the linearly polarized beams, the second layer further including two continuous copper strips each connecting co-planarly alongside of and contiguous to longitudinal edges of the second layer for reducing additional stray components of the linearly polarized beams;

a third layer or equally spaced co-planar parallel meandering conductive lines positioned in spaced relation to the second layer, the meandering lines of the third layer superposed diagonally over the conductive lines of the second layer for polarizing the linearly polarized beams into partially circularly polarized beams; and a fourth layer of equally spaced co-planar parallel meandering conductive lines superposed over the third layer of meandering conductive lines for further polarizing the partially circularly polarized beams into circularly polarized beams, thereby substantially eliminating the errors caused by raindrop reflections.

14. A method of forming a four-beam leaky waveguide antenna for eliminating errors caused by raindrop reflections, the four-beam antenna including a radome containing a reflector and waveguides, the method comprising the steps of:

feeding power alternately to different feed points of the waveguides for generating radiation to be sequentially reflected as four emitted linear beams by the reflector;

positioning a first layer of equally spaced co-planar parallel conductive lines over the reflector for polarizing the linear beams;

superposing a second layer of equally spaced co-planar parallel conductive lines perpendicularly over the first layer for purifying the linearly polarized beams;

superposing a third layer of conductive grid over the second layer of conductive lines for polarizing the linearly polarized beams into partially circularly polarized beams; and superposing a fourth layer of conductive grid over the third layer for polarizing the partially circular polarized beams into circularly polarized beams for substantially eliminating errors caused by raindrop reflections.

15. The method according to claim 14, wherein the superposing of the third layer step comprises:

positioning a dual set of spaced co-planar parallel conductive lines aligned perpendicularly to each other over the second layer, the conductive lines of the dual set further being oriented diagonally to the conductive lines of the second layer.

16. The method according to claim 15, wherein the superposing of the fourth layer step further comprises:

positioning a second dual set of spaced co-planar parallel conductive lines aligned perpendicularly to each other over the third layer, the conductive lines of the second dual set further being oriented diagonally to the conductive lines of the second layer.

17. The method according to claim 14, wherein the superposing of the third layer comprises:

positioning a layer of equally spaced co-planar parallel meandering conductive lines over the second layer.

18. The method according to claim 15, wherein the superposing of the fourth layer comprises:

positioning a layer of equally spaced co-planar parallel meandering conductive lines over the third layer.

* * * * *